US005596913A

United States Patent [19]

Matsubara et al.

[11] Patent Number: 5,596,913

[45] Date of Patent: Jan. 28, 1997

[54] WRENCH

[75] Inventors: Masayuki Matsubara; Yasuhiko Kitamura, both of Osaka, Japan

[73] Assignee: Daishowa Seiki Kabushiki Kaisha, Osaka, Japan

[21] Appl. No.: 272,219

[22] Filed: Jul. 8, 1994

[30] Foreign Application Priority Data

Jul. 8, 1993 [JP] Japan ..... 5-193106

[51] Int. Cl.[6] ..... B25B 13/00

[52] U.S. Cl. ..... 81/59.1

[58] Field of Search ..... 81/59.1; 192/44, 192/45

[56] References Cited

U.S. PATENT DOCUMENTS

| | | | |
|---|---|---|---|
| 1,412,688 | 4/1922 | Layton et al. . | |
| 2,896,488 | 7/1959 | Ahana . | |
| 3,906,822 | 9/1975 | Hertelendy et al. . | |
| 4,987,802 | 1/1991 | Chern | 81/59.1 |

FOREIGN PATENT DOCUMENTS

| | | |
|---|---|---|
| 860778 | 12/1952 | Germany . |
| 2231385 | 1/1974 | Germany . |
| 3245896A1 | 10/1983 | Germany . |
| 526208 | 11/1993 | Japan . |
| 2067115 | 7/1981 | United Kingdom . |

OTHER PUBLICATIONS

Copy of the Catalog of NTN.KK No. 6402–III/J published on Nov. 3, 1992.

*Primary Examiner*—D. S. Meislin
*Assistant Examiner*—Joni B. Danganan

[57] ABSTRACT

A wrench for tightening a tightening member to another member by revolving the tightening member around its axis, wherein the wrench comprises an inner surface which is attached to the outer surface of the tightening member. On the inner surface, a recess is provided to store a wedge member and is configured by a continuous formation of a slack area and a wedge area. The wedge member is configured to wedge between the outer surface of the tightening member and the wall of the wedge area when the wrench body is rotated in the one direction, in order to place the wedge member in the wedge area, whereby the wrench and the tightening member are unified regarding the relevant direction, enabling the rotation of the tightening member in the relevant direction through the wrench.

13 Claims, 12 Drawing Sheets

WRENCH

BACKGROUND OF THE INVENTION

1. Field of the Invention

The present invention relates to a tool for tightening a revolving tightening member, such as a nut and bolt or a nut on a chucking device for machine tools, and in particular, to a wrench which can easily be attached to the tightening member.

2. Description of the Related Art

In the past, various kinds of tighteners such as nuts and bolts which are tightened when revolved around an axis have been known. Generally, edges are provided on the outer surface of the tightening member by, for example, forming the tightening member into a prismatic shape, such as a hexagon. A wrench or other tool comprising an open end to fit the shape of the tightening member can be attached to grasp the outer surface edges of the tightening member. By revolving the tool, the tightening member can be tightened.

The above-mentioned mechanism can also be used for tightening nuts on chucking devices or cutting tool holders, i.e., the outer surface of the tightening nut is knurled, and a recess or engagement groove is formed to receive the wrench.

However, placing a wrench to the edges or engagement grooves of the nut is both time consuming and burdensome. Moreover, the manufacturing process for the nuts is made more complex, as recesses and grooves on the tightening member must be formed, or the tightening member must be formed in an edged shape.

Moreover, the relative angle of the wrench enabling it to connect with the edges or grooves of the nut is so limited that if the space around the nut is insufficient, the wrench may not be able to connect to the nut, depending on the angle of the nut.

SUMMARY OF THE INVENTION

Therefore, this invention, in order to solve the problems, provides a wrench which can be easily attached to the tightening member, which enables easier manufacturing of the tightening member, and which can easily tighten the tightening member even when there is not enough space in the area around the tightening member.

In order to achieve the above-mentioned objectives, the present invention is characterized by a wrench for tightening a tightening member to another member by revolving the tightening member around its axis, wherein the wrench comprises an inner surface which is attached to the outer surface of the tightening member, and a wedge member provided on the inner surface of the wrench which wedge between the outer surface of the tightening member and the above-mentioned inner surfaces through rotating the wrench body in at least one direction.

Also, a holding means to hold the wedge member in place may be provided on the inner surface, the holding means defining a slack area and a wedge area to keep the wedge member in place. The wedge member should wedge between the outer surface of the tightening member and the wall of the wedge area when the wrench body is rotated in one direction to place the wedge member in the wedge area. The wedge member may be configured to shift to the slack area by rotating the wrench body in the opposite direction.

Moreover, wedge areas may be successively formed on both sides of the slack area around the wedge member so that the wedge member shifts from the slack area to either of the wedge areas by rotating the wrench body in either direction, by which the wedge member wedges between the outer surface of the tightening member and the wall of the wedge area.

According to the present invention, the wedge member wedges between the outer surface of the tightening member and the inner surface of the wrench by rotating the wrench body in at least one direction, whereby the wrench and the tightening member are unified regarding the same direction to enable the rotation of the tightening member toward the same direction through the wrench. Therefore, providing edges on the outer surface of the tightening member to receive the wrench is not necessary, enabling the formation of the tightening member into a cylindrical shape. As a result, as the necessity of providing edges, etc. on the outer surface of the tightening member is eliminated, it is no longer time consuming or difficult to attach the wrench to the tightening member, and manufacture of the tightening member becomes easier.

DETAILED DESCRIPTION OF THE PREFERRED EMBODIMENTS

Figure 1:
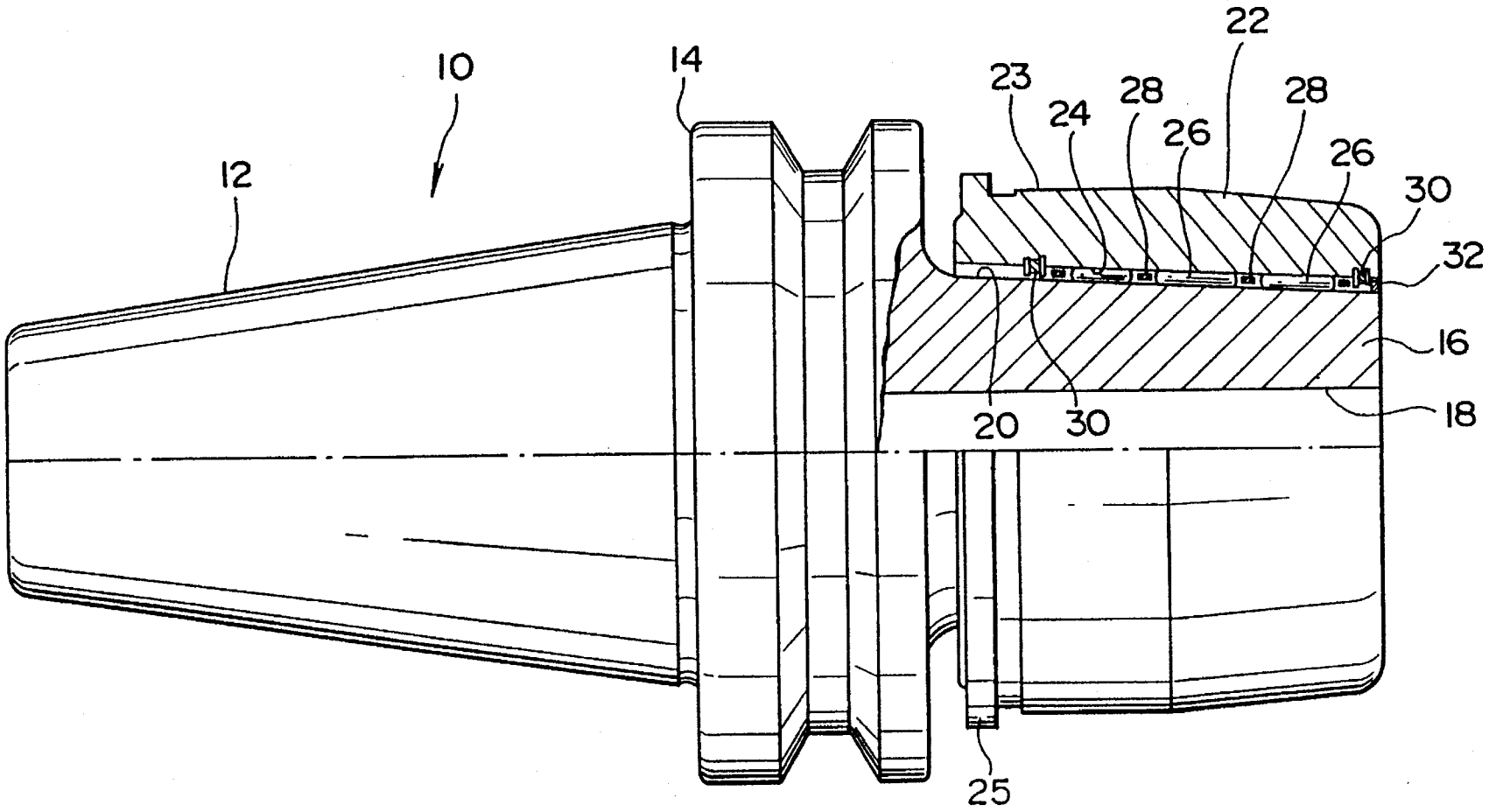
FIG. 1 illustrates a partially cut out cross section of a chuck to which the present invention is applied.

One embodiment of the present invention is now explained by using the example of a tool holder, i.e., a chuck, to secure a machine tool, such as a drill. In FIG. 1, the numeral 10 denotes generally a chuck body. The chuck body 10 is to be attached to a machining center or other main spindle head (not shown), and comprises a tapered shank portion 12 which tapers toward the base end, i.e., to the left in FIG. 1; a chuck placement flange portion 14 formed next to the tapered shank portion 12; and a chuck tube 16 which projects toward the top end portion from the flange portion 14 as a part of the chuck. This chuck tube 16 comprises an inner surface 18 to receive a straight shank portion or a collet of the machine tool, and an outer surface 20 which is tapered toward the top end portion. Rotatable on the outer surface 20 of the chuck tube 16 is a cylindrical rotating tube or a tightening nut 22 as a tightening member. This rotating tube 22 has an inner surface 24 tapered toward the top end portion corresponding to the outer surface 20 of the chuck tube 16. Around the base portion of the rotating cylinder 22, a circumferential stopper 25 projects slightly toward the outward direction at its radius to prevent the falling off of a below-mentioned wrench from the rotating tube 22.

A plurality of rotatable needle rollers 26 are provided between the rotating tube 22 and the chuck tube 16, which are held by a retainer 28. Through rotation of the rotating tube 22, the needle rollers 26 rotate and at the same time revolve in a helix around the outer surface 20 of the chuck tube 16, whereby the chuck tube 16 is able to grasp the tool. The numeral 30 indicates a sealing member and the numeral 32 indicates a stop ring, both of which prevent the needle rollers 26 from falling off. The outer surface 23 of the rotating tube 22 is smooth, and is neither knurled nor provided with any recess for receiving the conventional wrench, as opposed to the conventional rotating tube of a chuck.

Figure 2:
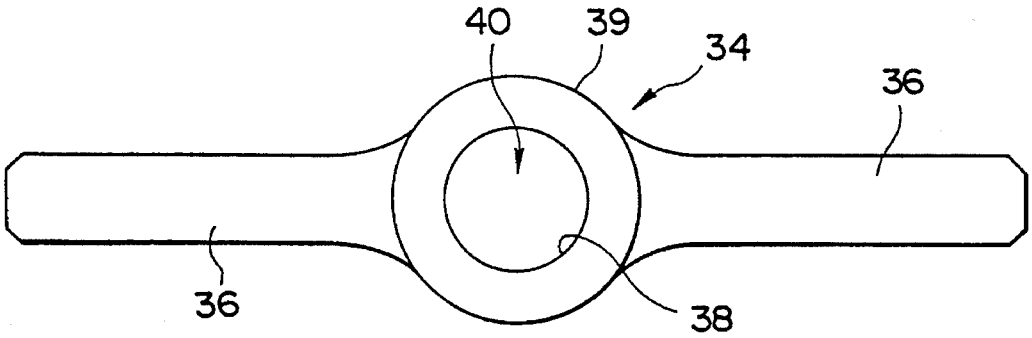
FIG. 2 is a front view of a wrench according to a first embodiment of the present invention.

FIG. 2 illustrates a wrench 34 for rotating the rotating tube 22 to tighten the chuck tube 16 onto a machine tool. This wrench 34 has a main body portion 39, which includes a wrench opening 40, the cross section of which is a circle having an inner diameter slightly larger than the outer diameter of the rotating tube 22 to enable insertion of the rotating tube 22, and a pair of handles 36 uniformly provided on the main body portion 39. A wedge mechanism is provided on the inner surface 38 of the wrench opening 40.

Figure 4:
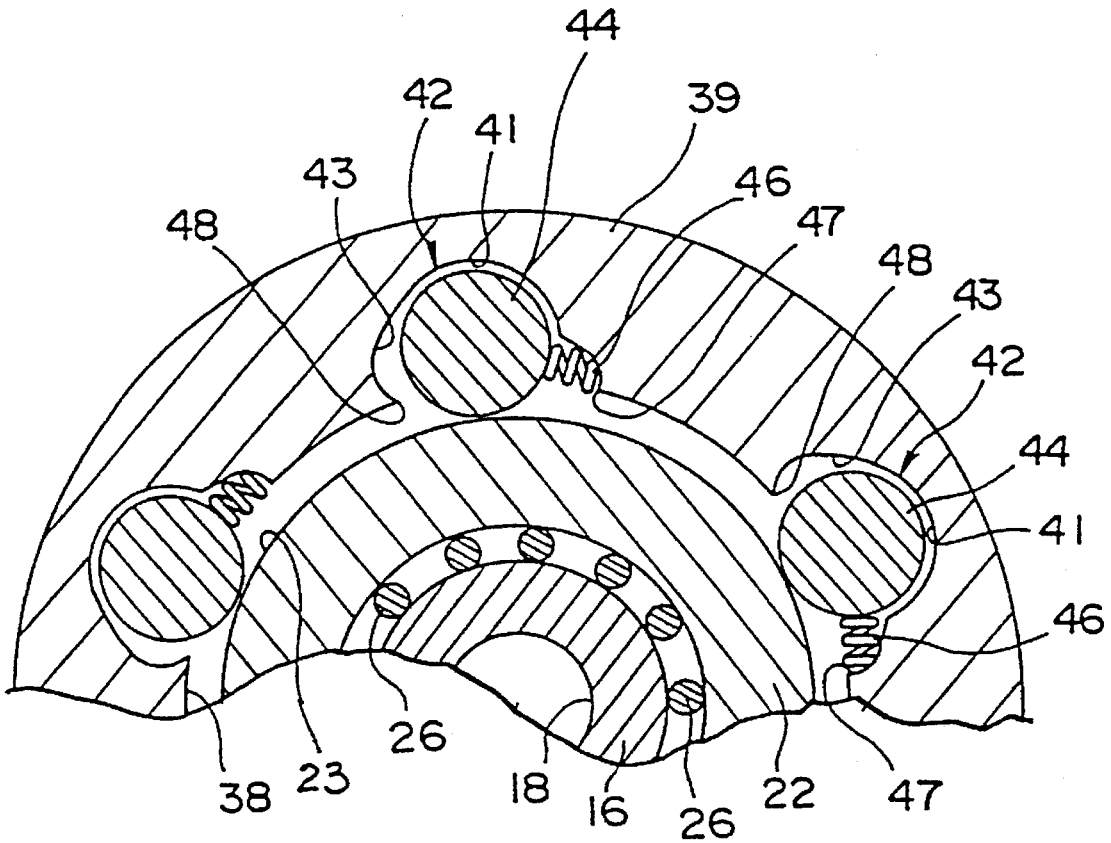
FIG. 4 is a cross sectional view taken along IV—IV of FIG. 3.
Figure 5:
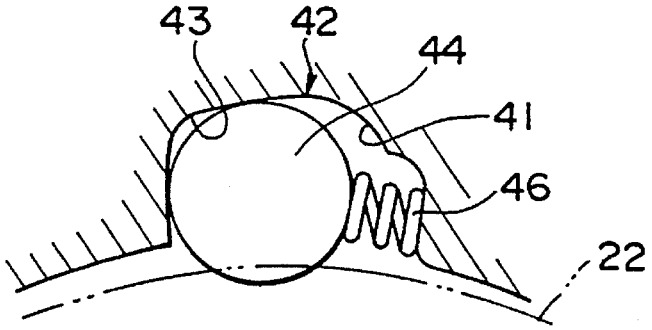
FIG. 5 is an enlarged view of a wedge mechanism before attaching the wrench to the rotating tube.

As shown in FIG. 4, the wedge mechanism comprises a plurality of cylindrical wedge members 44 placed on the circumference of the inner surface 38 within a certain distance from each other, a recess 42 to receive each of the wedge members 44, and coil springs 46 to bias each of the wedge members 44 toward the counter-clockwise direction in FIG. 4. Each of the recesses 42 is formed to receive the cylindrical wedge members 44, caving in from the inner surface 38 of the wrench opening 40, and extending toward the axis at a predetermined length (i.e., the direction perpendicular to the paper face in FIG. 4). The recess 42 is configured to define a slack area which has a rather deep recess, and a wedge area adjacent to the slack area with a shallower recess than the slack area 41. The volume of the slack area 41 is sufficient for the wedge member to freely roll, and the depth of the slack area 41 is formed slightly smaller than the diameter of the wedge member 44 so that a portion of the wedge member 44 projects from the inner surface 38 toward the center. The depth of the wedge area 43 is rather shallow so that the wedge member 44 wedges between the wedge area and the outer surface 23 of the rotating tube 22. The spring 46 is stored in the spring housing 47, and biases the wedge member 44 toward the counter-clockwise direction, i.e., from the slack area 41 toward the wedge area 43, and at normal conditions where the wrench body is not attached to the rotating tube 22, the wedge member 44 is located at the wedge area 43, as shown in FIG. 5. A projection 48 is formed at the end of the recess opposite the spring housing 47, and the wedge member 44 is prevented from falling off by the projection 48 and the biasing force of the spring 46.

Figure 3:
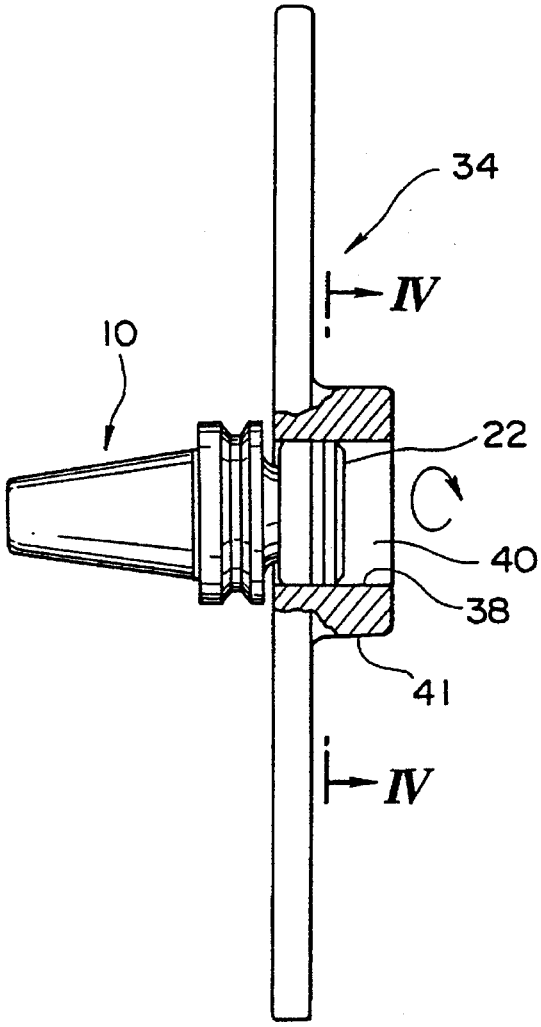
FIG. 3 is a partially cut out side view of a state where wrench is attached to a chuck to be tightened.

Now the operation of this embodiment is explained. First of all, the wrench opening 40 is placed around the outer surface of the rotating tube 22 of the chuck body 10, as shown in FIG. 3. At this point, the wedge member 44 is in contact with and pushed by the rotating tube 22 from the wedge area 43 to the slack area 41, i.e., from the state shown in FIG. 5 to that shown in FIG. 6, against the biasing force of the spring 46. As this slack area 41 holds the wedge member 44 with slack, the wedge member 44 does not wedge between the rotating tube 22 and the inner wall. Therefore, in placing the wrench opening 40 to the rotating tube 22, although the outer surface of the wedge member 44 is in contact with the outer surface 23 of the rotating tube 22, the wedge member does not interfere with the placing operation itself, and one can smoothly attach the wrench opening 40 to the rotating tube 22. The rotating tube 22 has a smooth cylindrical shape, and thus there is no need to orient the wrench 34 in accordance with the shape of the rotating tube 22.

Figure 6:
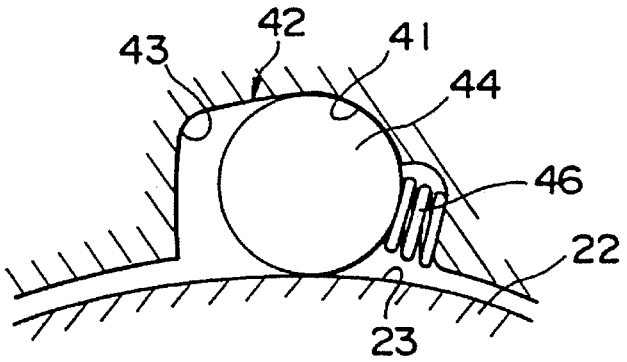
FIG. 6 is an enlarged view of a wedge mechanism when the wrench is attached to the rotating tube.
Figure 7:
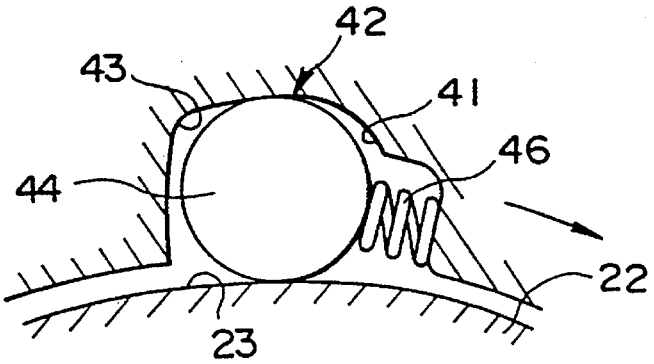
FIG. 7 is an enlarged view of a wedge mechanism when the wedge member wedges between the wall of the wedge area and the outer surface of the rotating tube.

When the wrench 34 is rotated in a clockwise direction in FIG. 6, i.e., to the direction shown by the arrow in FIG. 3, the wedge member 44 rotates and shifts in a relatively counter-clockwise direction, through contact with the inner surface of the slack area 41 of the recess 42 and the outer surface 23 of the rotating tube 22, and by the biasing force of the spring 46. When the wedge member 44 shifts in a relatively counter-clockwise direction, the wedge member 44 is placed at the wedge area 43, and the wedge member 44 wedges between the wall of the wedge area and the outer surface 23 of the rotating tube 22, whereby the wrench and rotating tube are locked together regarding the same direction. Therefore, when the wrench is further rotated to the same direction, the rotating tube 22 rotates clockwise with the wedge member 44. Through this rotation, the rotating tube 22 shifts toward the base end portion of the chuck body, and thereby the inner surface 18 of the chuck tube 16 contracts so that a machine tool, such as a drill or end mill, can be tightly secured within the chuck tube 16.

When the wrench 34 is to be removed from the rotating tube 22, the wedge member 44 shifts in a relatively clockwise direction by the counter-clockwise rotation of the wrench 34, and is placed in the slack area 41 of the recess 42. Since the slack area 41 is a deep recess, as stated above, the outer surface of the wedge member 44 does not wedge between the wall of the wedge area 43 and the outer surface 23 of the rotating tube 22, and thus the wrench 34 can be easily removed from the rotating tube 22.

In this embodiment, when the wrench 34 is rotated in a clockwise direction, the wedge member 44 wedges between the recess 42 and the rotating tube 22, and when the wrench 34 is rotated in a counter-clockwise direction, the wrench slips as the wedge member 44 does not wedge between the recess 42 and the rotating tube 22. Therefore, the rotating tube can be tightened by repeating rather small forward and backward rotations.

Figure 8:
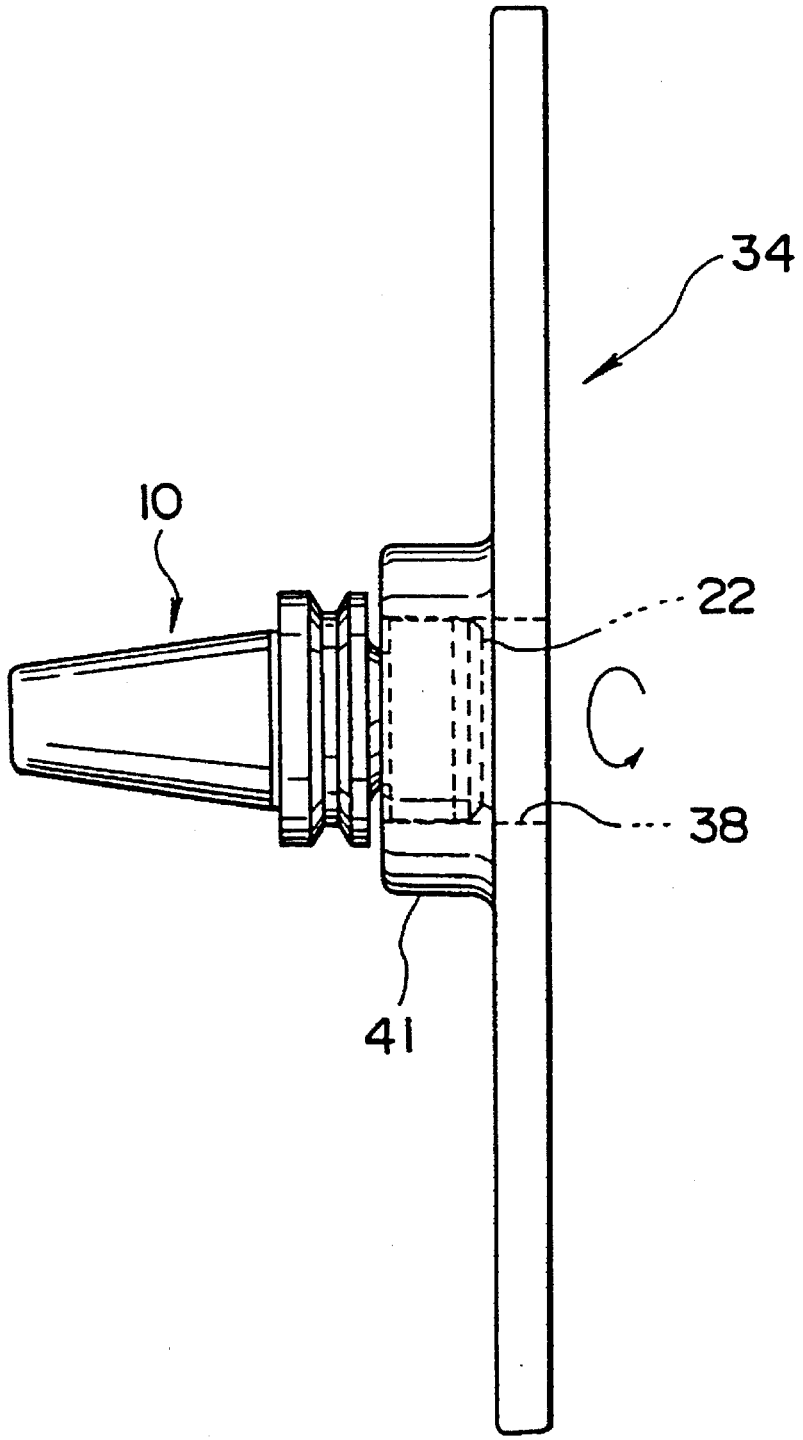
FIG. 8 is a side view of a state where a wrench is attached to a chuck to be loosened.

When the machine tool is to be removed from the chuck tube 16, the wrench 34 is attached to the rotating tube 22 backwards; i.e., from the side opposite to that used for securing the machine tool to the chuck tube 16, as shown in FIG. 8, and the wrench 34 is rotated counter-clockwise, i.e., the direction shown by the arrow in FIG. 8. Thereby, the rotating tube 22 rotates counter-clockwise by the wedge members 44 in the same manner as explained above, and the rotating tube 22 shifts in the left hand direction in FIG. 1. The inner surface 18 of the chuck tube 16 returns to expand, and the machine tool can be removed from the chuck tube 16.

According to this embodiment, the wrench 34 can be easily attached to the rotating tube 22 without the need for adapting the wrench 34 to the shape of the rotating tube 22. Moreover, according to this embodiment, the outer surface of the rotating tube 22 need not be knurled or provided with a recess to snap on the wrench, and thus the rotating tube can be formed in a cylindrical shape with a smooth surface. Therefore, it is easy to manufacture the rotating tube 22, the airing noise during rotation of the rotating tube 22 can be prevented, and in particular, rotational balance can be maintained during high-speed rotation of the chuck body.

Although the pair of handles 36 to rotate the wrench are provided symmetrically from the main body 39 in this embodiment, the pair of handles need not be formed in exactly the same way, and the number of handles may be alternatively one or three, so long as the rotation tube 22 can be rotated. While the wedge member 44 is formed into a cylindrical shape in this embodiment, the shape of the wedge member in this embodiment is not intended to limit the present invention, and the wedge member can be in any shape, for example, a spherical shape, so long as it rotates. Moreover, while the rotating tube (a tightening member) is formed in a circular shape and is not knurled in this embodiment, the shapes of this embodiment are not intended to limit the present invention, and the rotating tube may be uneven if necessary. While the coil spring 46 is used as a spring in this embodiment, the spring in this embodiment is not intended to limit the present invention, and, for example, a plate spring may also be used.

Figure 9:
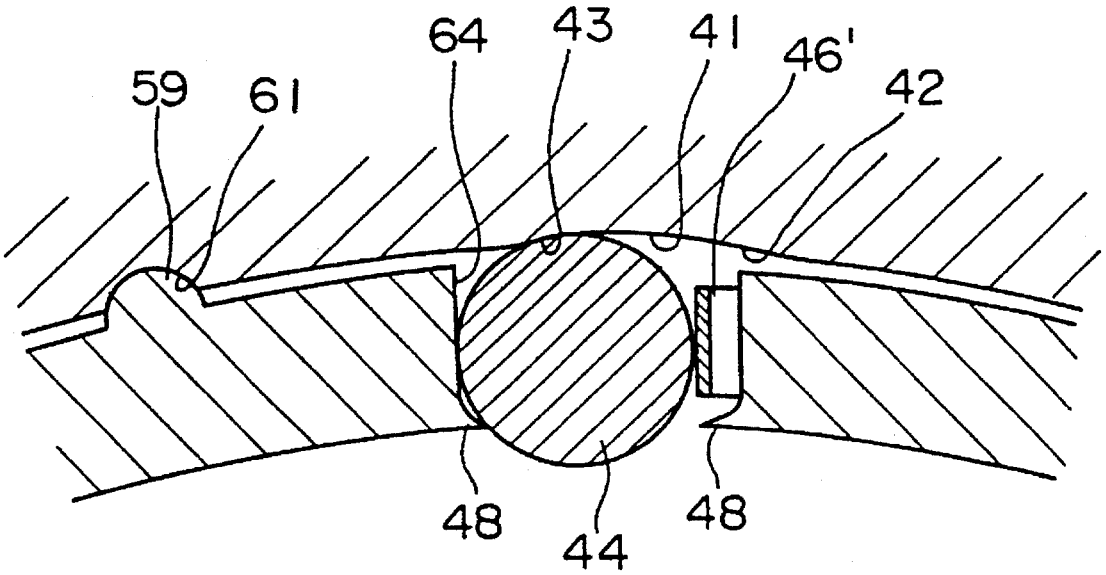
FIG. 9 is a cross section of the key elements illustrating a second embodiment of the present invention.

FIG. 9 illustrates the second embodiment of the present invention. This embodiment differs from the first embodiment in that a retainer 58, the inside of which is circular shaped, is secured on the inner surface of the wrench 34 and the wedge members 44 are stored at a plurality of storing recesses 64 formed on the retainer 58, and in that a plate spring 46' is used instead of the coil spring.

The retainer 58 is formed in a circular shape, and is secured to the inner surface of the wrench by the outward projection 59 which engages with a recess 61 formed on part of the inner surface 38 of the wrench. The plate spring 46' is formed into an arch shape, the center portion of which projects toward the wedge member 44 to bias the wedge member toward the wedge area.

As stated above, the retainer 58 holds the wedge member so that the wedge member can move, and the slack area 41 and the wedge area 43 are configured with a relatively shallow recess 42 formed on the inner surface of the wrench, and thus it is easier to manufacture the inner surface of the wrench than that disclosed in the first embodiment, where the both areas are formed with only the inner surface of the wrench holding the wedge members.

Figure 10:
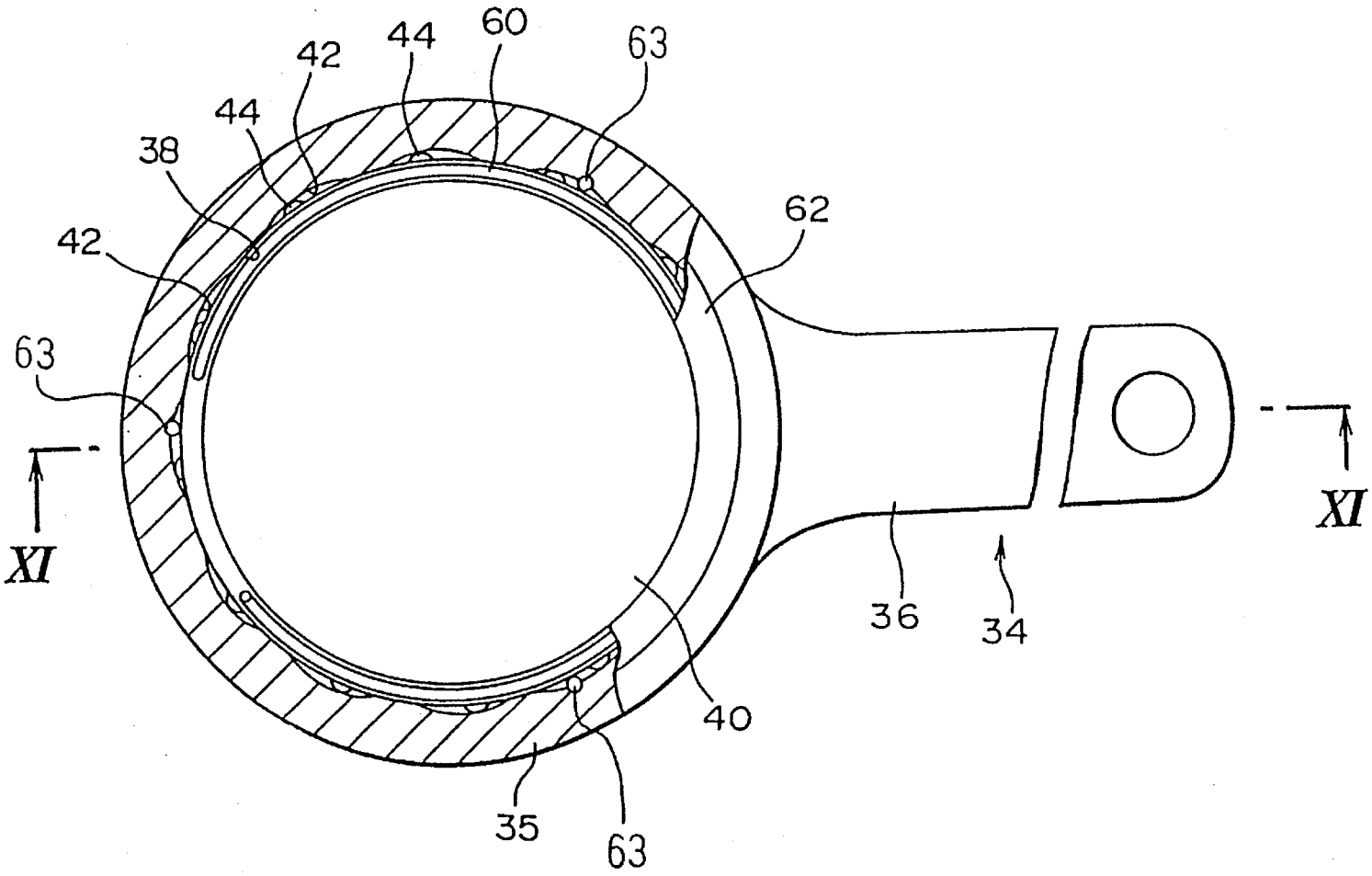
FIG. 10 is a partially cut out plan view illustrating a third embodiment of the present invention.
Figure 11:
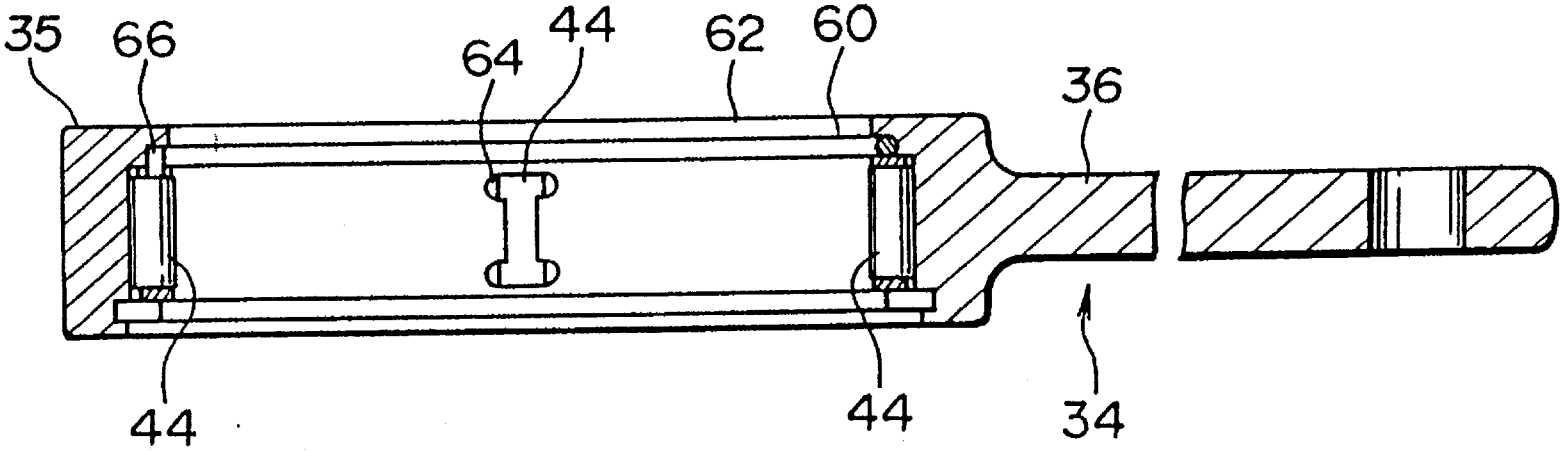
FIG. 11 is a cross section taken along XI—XI of the FIG. 10.
Figure 12:
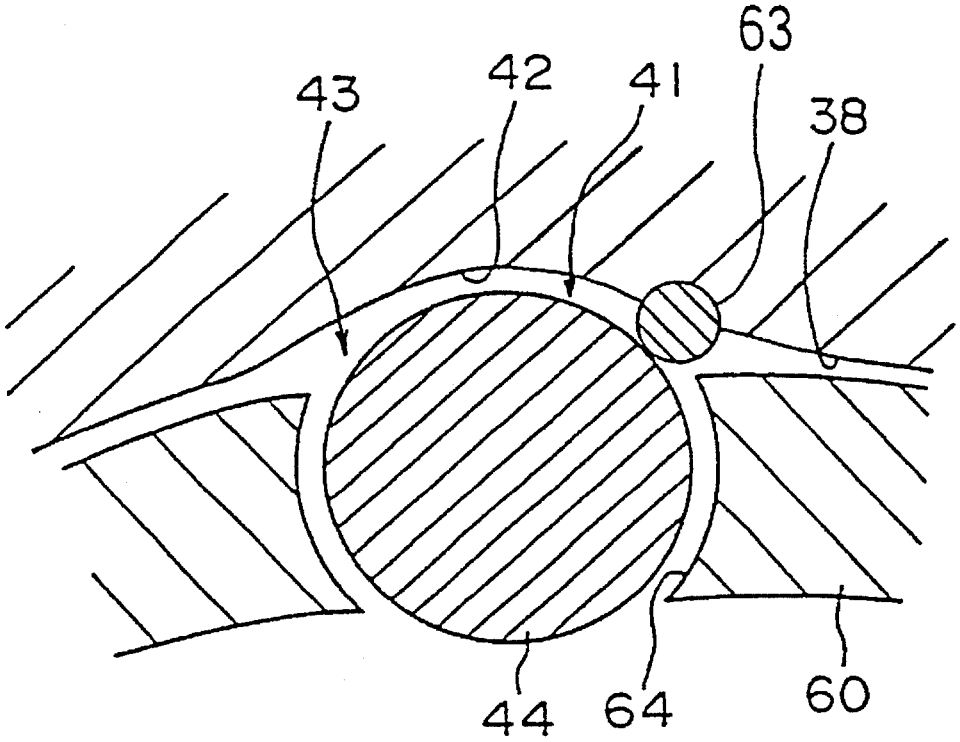
FIG. 12 is a cross section of the third embodiment at the same position as that shown in FIG. 9.

FIGS. 10 through 12 illustrate the third embodiment of the present invention. This embodiment differs from the second embodiment disclosed above in that the retainer 58 is not secured to the wrench such that the entire retainer 58 rolls along the circumference of the wrench 34 to move the wedge member from the slack area to the wedge area, and in that biasing means are provided on the retainer, rather than on each wedge member, so that each of the wedge members is biased from the slack area toward the wedge area. In this embodiment, the components that are the same as those disclosed in the first embodiment are given the same numerals, and explanations thereof have been omitted.

The wrench 34 in this embodiment mainly comprises the wrench body 35, a cylindrical retainer 58 provided at the inner surface of the wrench body 35, a spring 60 to bias the retainer 58 in the direction of the circumference, and a lid member 62 to hold the spring 60 and the retainer 58.

More specifically, the rotatable retainer 58 is provided on the inner surface 38 of the wrench body 35 in the direction of the circumference, onto which a plurality of storing recesses 64 to store the wedge members 44 are provided with predetermined distances between them on the circumference of the retainer 58 so that the wedge members 44 are rotatable but not movable within the respective recesses 64, as they are stored in the recesses. By the configuration to keep wedge members 44 in the retainer 58, in this embodiment, a plurality of wedge members 44 moves in the direction of the circumference together with the retainer 58. In this embodiment, the slack area 41 and the wedge area 43 are also formed by a recess 42 on the inner surface 38 of the wrench body. Each recess 42 in this embodiment is formed to define the slack area 41 in the middle and the wedge areas 43 on both opposite sides for the purposes of easy manufacturing. Reference numeral 63 denotes a stopper to keep the wedge member 44 and the retainer 58 from moving toward one of the wedge areas in the clockwise direction, so that rotation of the wrench 34 in a counter-clockwise direction does not cause the wedge member to be in the wedge area to lock the wrench with the rotating tube.

Figure 13:
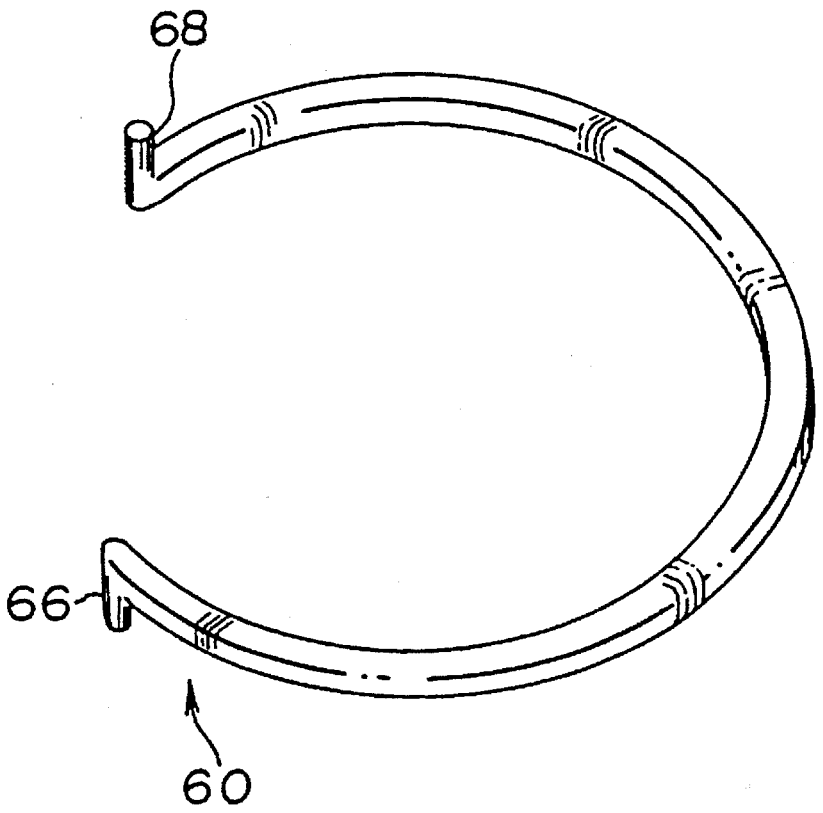
FIG. 13 is a perspective view of the spring used in the third embodiment.

As shown in FIG. 13, a spring 60 is formed into an almost circular shape, and small projections **65*a*, 65*b* are provided on both ends. One of the small projections 65*a* is connected to an engagement recess (not shown) formed on the top surface of the retainer 58, and the other small projection 65*b* is connected to an engagement recess (not shown) formed on the lid member 62. As such, the retainer 58 is always biased so that the wedge member 44 moves from the slack area 41 to the wedge area 43**.

According to the third embodiment, the wedge member 44 may be biased from the slack area 41 to the wedge area 43 by using one spring, thereby reducing the number of components and simplifying the assembly.

Figure 14:
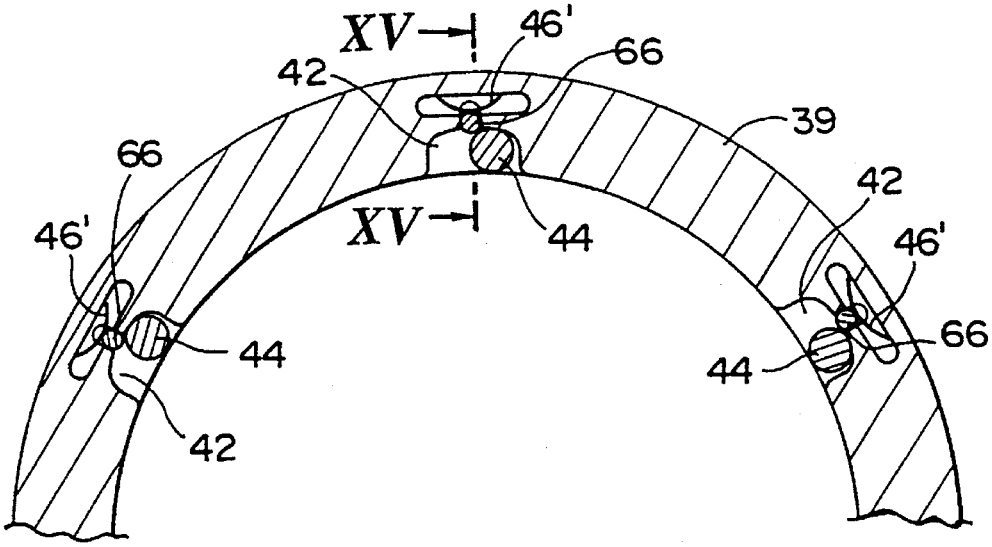
FIG. 14 is a cross section illustrating a fourth embodiment of the present invention.
Figure 15:
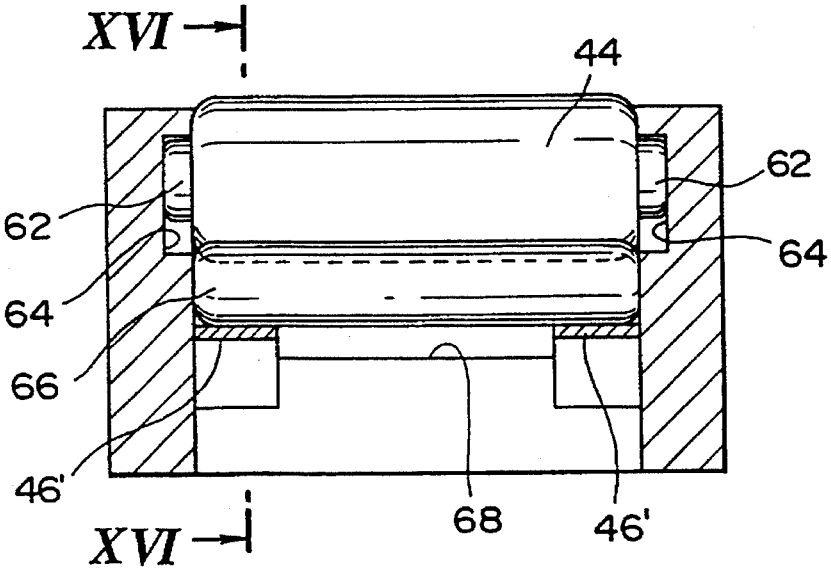
FIG. 15 is a cross section taken along XV—XV of FIG. 14.
Figure 16:
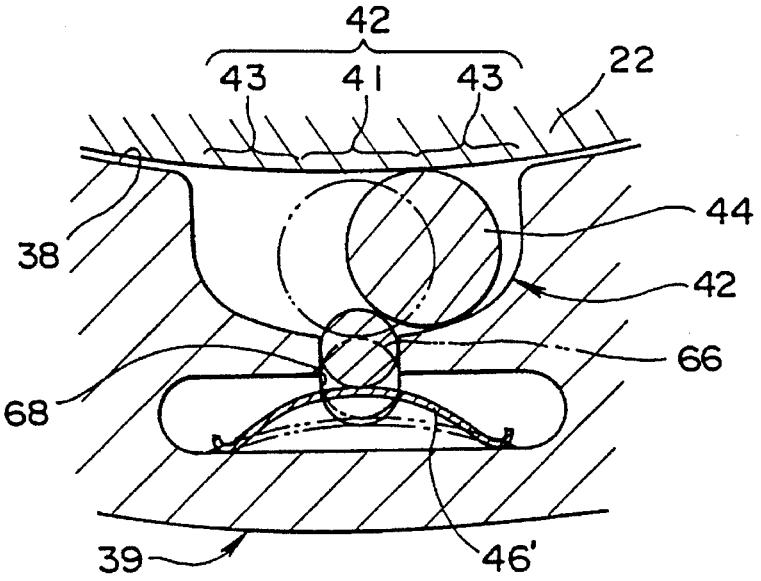
FIG. 16 is a cross section taken along XVI—XVI of FIG. 15.

FIG. 14 illustrates the fourth embodiment of the present invention. In this embodiment, as opposed to the first embodiment explained above, wedge areas 43 are continuously provided on both sides, in the direction of circumference of the slack area 41, as shown in FIG. 16. A concave recess 68, caved in from its wall, is provided on the wall of the slack area 41, and a cylinder 66 is provided along with the concave recess 68 so that the cylinder may both appear into and disappear from the recess 42. The cylinder 66 is always biased to the center of the main body 39 by a plate spring 46', and projects into the recess 42 from the concave recess 68 at normal conditions before the wrench 34 is attached to the rotating tube 22. Therefore, as shown in FIG. 16 by the solid wedge member 44, before the wrench is attached to the rotating tube, the wedge member 44 is placed at either of the wedge areas 43, left or right, being urged by the cylinder 66. Boss portions 62 are provided on both ends of the wedge member 44, and are attached to both sides of the recess 42 to prevent the wedge member 44 from falling off from the recess 42, i.e., attachment recesses 64 provided on the left and right sides, as shown in FIG. 15.

The operation of this embodiment is now explained. When the wrench opening 40 is attached to the rotating tube 22, the wedge member 44 comes into contact with the rotating tube 22, and is pushed by the rotating tube 22 to escape from the wedge area 43 to the slack area 41 as shown by the dotted line in FIG. 16, causing the cylinder 66 to move backward against the biasing force of the spring 46'. Therefore, the wrench opening 40 can be smoothly attached to the rotating tube 40, and the particular placement of the wrench 34 that fits with the particular shape of the rotating tube 22 is unnecessary.

As shown by the solid line in FIG. 16, when the wrench 34 is rotated clockwise, the wedge member 44 rolls towards the wedge area 43 located in the counter-clockwise direction, is pushed into that wedge area by the projecting force of the cylinder 66, and wedges between the wall of the wedge area 43 and the outer surface of the rotation tube 22, whereby the wrench and the rotating tube are unified. Therefore, when the wrench is further rotated to the same direction, the rotating tube 22 rotates clockwise by the wedge member 44 such that a machine tool, such as a drill, can be secured.

When the wrench 34 is removed from the rotating tube 22 by slightly rotating the wrench 34 in a counter-clockwise direction, the wedge member 44 moves in a relatively clockwise direction, and is stored in the slack area 41 of the recess 42. By this operation, the wrench 34 can be easily removed from the rotating tube 22, as mentioned in the preceding embodiment.

Unlike the first embodiment, when the machine tool is to be removed from the chuck tube 16, the wrench 34 may be attached to the rotating tube 22 without regard to the side of the wrench at the time of securing the machine tool to the chuck tube 16. When the wrench is rotated in a counter-clockwise direction after attaching it to the rotating tube, the wedge member 44 moves to the wedge area 43 located at the relatively clockwise side of the slack area, and wedges between the wall of the wedge area 43 and the outer surface 23 of the rotating tube 22, whereby the wrench and the rotating tube are unified. Therefore, by further rotating the wrench 34 in a counter-clockwise direction, the rotating tube 22 rotates counter-clockwise by the wrench 34 so that a machine tool such as a drill can be removed from the chuck. According to this embodiment, the side of the wrench for removing the machine tool does not need to be changed from the side for securing the machine tool.

Figure 17:
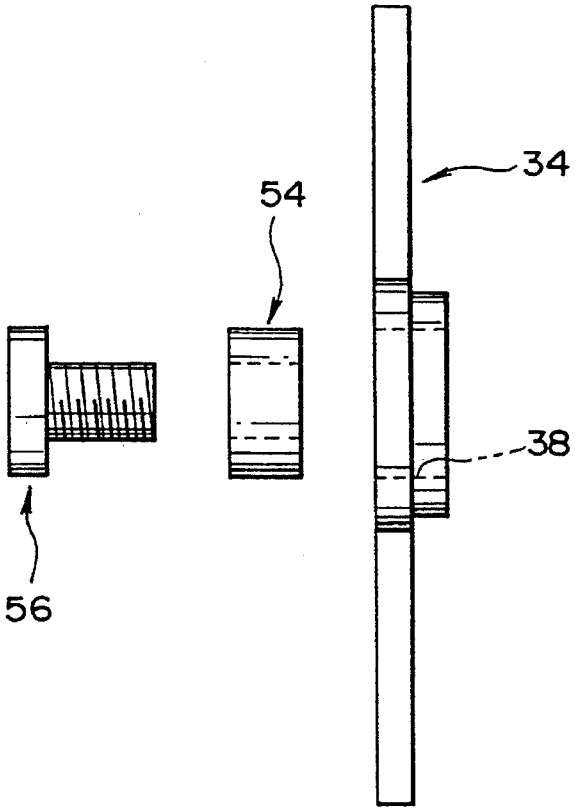
FIG. 17 is a side view of the wrench and a nut and bolt according to a fifth embodiment of the present invention.

In these embodiments, the rotation tube or tightening nut of a chuck has been explained as an example for the tightening member. However, these embodiments are not intended to limit the present invention, and the present invention may be applied, for example, for tightening a nut 54 with a bolt 56 as in the fifth embodiment shown in FIG. 17. The head of the nut 54 and the bolt 56 has a smooth circumference without any edges, etc. to hook the wrench. The structure of the wrench 34 is the same as that explained in the first embodiment, and thus, the explanation of the wrench is not repeated. As in the third embodiment, it is easier to manufacture the nut 54, as the outer surface of the nut 54 has no edge to hook the wrench, and attaching the wrench 34 to the nut 54 is also not difficult, as adapting the wrench to the shape of the nut is unnecessary. Moreover, as the nut in this embodiment does not have edges, wearing down of head edges, thus making the nut unusable is prevented.

The present invention provides a wrench which can be easily attached to the tightening member, and which enables easier manufacturing of the tightening member easy, and a wrench which can be easily tightened even when there is an obstacle around the tightening member, can be provided.

What is claimed is:

1. A wrench for tightening a tightening member to another member by rotating the tightening member around its own axis, comprising:

an inner surface to be attached to the outer surface of said tightening member;

a wedge member arranged on said inner surface for wedging between the outer surface of the tightening member and said inner surface when said wrench is rotated in at least one direction; and a holding means provided on said inner surface to hold said wedge member, including:

i) a recess with a circular-curved cross section formed on the inner surface of the wrench for receiving the wedge member, said recess including a slack portion for housing said wedge member in a non-wedging position, and wedging portions flanking said slack portion for extending said wedge member into a wedging position;

ii) a retainer provided on the inner surface of the wrench for limiting the extent that said wedge member is extended into said wedging position, and iii) a pin-like stopper for preventing said wedge member from moving from said slack portion in the recess to one of said wedging portions.

2. A wrench according to claim 1, wherein the slack portion depth of the recess is deeper than the wedge portion depth of the recess.

3. A wrench according to claim 1, wherein the wedge member is cylindrical in shape.

4. A wrench according to claim 1, wherein the wedge member is spherical in shape.

5. A wrench according to claim 1, wherein the retainer is installed so that it is movable in the direction of the circumference of the inner surface of the wrench body to a predetermined extent, and has a cavity to keep the wedge member in a predetermined position.

6. A wrench according to claim 1, wherein said inner surface is constructed such that it completely surrounds the outer surface of the tightening member.

7. A wrench for tightening a tightening member to another member by rotating the tightening member around its own axis, comprising:

an inner surface to be attached to the outer surface of said tightening member;

a wedge member arranged on said inner surface which is wedged between the outer surface of the tightening member and said inner surface by rotating the wrench body in one direction; and a holding means provided on said inner surface for holding said wedge member, including i) a recess with a circular-curved cross section formed on the inner surface of the wrench body for receiving the wedge member, said recess including a slack portion for housing said wedge member in a non-wedging position, and wedging portions flanking said slack portion for extending said wedge member into a wedging position;

ii) an annular retainer arranged around the inner surface of the wrench for limiting the extent that the wedge member is extended into said wedging position, and iii) a bias means for biasing the retainer so that the wedge member is biased from the slack area towards the wedge area, said bias means including a ring-shaped spring corresponding to the shape of the retainer.

8. A wrench according to claim 7, said wedge member being constructed such that it is placed from the slack portion to the wedge portion by rotation of the wrench body in said one direction so that it is wedged between the outer surface of the tightening member and a wall of said wedge portion.

9. A wrench according to claim 7, wherein the slack portion depth of the recess is deeper than the wedge portion depth of the recess.

10. A wrench according to claim 7, wherein the wedge member is cylindrical in shape.

11. A wrench according to claim 7, wherein the wedge member is spherical in shape.

12. A wrench according to claim 7, wherein the retainer is installed so that it is movable in the direction of the circumference of the inner surface of the wrench body to a predetermined extent, and has a cavity to keep the wedge member in a predetermined position.

13. A wrench according to claim 7, wherein said inner surface is constructed so that it completely surrounds the outer surface of the tightening member.

* * * * *